US008474162B1

(12) United States Patent
Glass

(10) Patent No.: US 8,474,162 B1
(45) Date of Patent: Jul. 2, 2013

(54) ORNAMENT GIFT CARD HOLDER

(75) Inventor: Brett R. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 12/793,676

(22) Filed: Jun. 3, 2010

Related U.S. Application Data

(60) Provisional application No. 61/183,891, filed on Jun. 3, 2009.

(51) Int. Cl.
*G09G 1/00* (2006.01)

(52) U.S. Cl.
USPC ..... 40/124.03; 40/124.06; 40/654.01

(58) Field of Classification Search
USPC ..... 40/124.03, 124.06, 775, 776, 654.01
See application file for complete search history.

(56) References Cited

U.S. PATENT DOCUMENTS

| | | | | |
|---|---|---|---|---|
| 3,888,408 | A * | 6/1975 | Clipner | 229/75 |
| 3,948,436 | A * | 4/1976 | Bambara | 206/523 |
| 5,245,171 | A * | 9/1993 | Fox et al. | 235/492 |
| 5,577,918 | A * | 11/1996 | Crowell | 434/319 |
| 5,639,523 | A * | 6/1997 | Ellis | 428/34.2 |
| 6,493,970 | B1 | 12/2002 | McCarthy et al. | |
| 6,845,583 | B2 | 1/2005 | Lee | |
| 6,877,263 | B2 | 4/2005 | Clark | |
| 7,024,807 | B2 | 4/2006 | Street | |
| 7,127,841 | B1 | 10/2006 | Weber | |
| 7,222,446 | B2 | 5/2007 | Foster | |
| 7,360,710 | B2 | 4/2008 | Lindahl et al. | |
| 7,374,095 | B2 * | 5/2008 | Blank et al. | 235/486 |
| 7,409,788 | B2 | 8/2008 | Lauer et al. | |
| 7,434,735 | B2 | 10/2008 | Dean et al. | |
| 7,438,224 | B1 | 10/2008 | Jensen et al. | |
| 7,490,720 | B2 | 2/2009 | Cole et al. | |
| 2004/0249748 | A1 | 12/2004 | Schultz et al. | |
| 2007/0017973 | A1 * | 1/2007 | Blank et al. | 235/380 |
| 2007/0094901 | A1 | 5/2007 | Kibbe et al. | |
| 2007/0144044 | A1 | 6/2007 | Kershner et al. | |
| 2007/0169387 | A1 * | 7/2007 | Glass | 40/124.03 |
| 2007/0277416 | A1 | 12/2007 | Fedan | |
| 2008/0098628 | A1 * | 5/2008 | Geitner | 40/124.06 |

OTHER PUBLICATIONS

PRI Plastic Resources Inc., http://www.plasticresource.com/carriers/hanging/standard/c7105/PRI-C-7105.pdf.
Intech Direct, Inc., http://www.intechdirect.com/products/valupak, http://www.intechdirect.com/images/uploads/products/valupakbacksample.jpg.

* cited by examiner

*Primary Examiner* — Casandra Davis
(74) *Attorney, Agent, or Firm* — Polsinelli PC

(57) ABSTRACT

An ornament gift card holder that includes a removably attached gift card, a slot for inserting the gift card into the holder after removal for loading at the point of purchase, a loop, hook or similar means for hanging the holder upon a Christmas tree or other desired location, and audio circuitry for recording and playing sound such as music and/or a message from the gift giver.

11 Claims, 5 Drawing Sheets

ORNAMENT GIFT CARD HOLDER

CROSS REFERENCE TO RELATED APPLICATIONS

This application claims the benefit of the prior filed, co-pending provisional application Ser. No. 61/183,891, filed Jun. 3, 2009.

BACKGROUND OF THE INVENTION

This invention relates generally to gift cards and more particularly to a device for holding and displaying gift cards while providing indicia and/or audio recordings selected or provided by the purchaser to personalize the gift.

Transaction cards, stored value cards, or gift cards as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, may be selected at the point of sale by the purchaser and loaded by the cashier using a magnet card reader/writer. Gift cards may, alternatively, be provided with a bar code or account number that links the card to a system account in which a record is stored associated with a monetary value. While popular, gift cards are typically provided with a generic and impersonal design, typically identifying only the associated merchant for which the card may be used to purchase merchandise, and therefore are not personalized in view of the intended recipient.

Devices for recording, storing and playing back audio have been associated with greeting cards and the like, such as is disclosed in U.S. Pat. Nos. 5,577,018, 5,652,606 and 6,845,583. The audio circuitry typically includes a speaker that also functions as a microphone when recording a message, a control circuit, a memory circuit to provide random access memory, one or more switches, batteries to provide power to the device, and associated wiring and mounting hardware. Gift card holders provided with audio components are known in the prior art as disclosed in U.S. patent application Ser. Nos. 11/539,277 and 11/788,025. These devices typically comprise a molded plastic housing for holding the audio circuitry. Gift card holders designed for use as ornaments are known in the prior art. For example, U.S. patent application Ser. No. 11/582,226 discloses a molded ornamental gift card holder that includes a window for holding and displaying the gift card. U.S. patent application Ser. No. 11/445,780 discloses an ornamental gift card holder that includes either a pocket for receiving and holding a gift card or gripping elements that engage the sides of a gift card for holding it against the body of the ornament.

What is needed, therefore, is a gift card holder that enhances the gift by providing sound, while housing the gift card in an inexpensively produced and lightweight structure that may be hung as an ornament.

BRIEF DESCRIPTION OF THE INVENTION

The purpose of this invention is to provide a gift card holder that bears indicia for indicating the name of the sender and recipient of the gift card, decorations of various styles or themes, a slot for inserting a gift card into the holder, means for hanging the holder upon a Christmas tree or other desired location, and audio circuitry for recording and playing sound such as music and/or a message from the gift giver, the circuitry typically including a sound speaker and a microphone, a power source such as one or more commonly available watch batteries, and record and playback buttons. Typically, the holder is sold to the gift giving consumer with a gift card attached. The gift card may be attached to the holder using removable adhesive so that the card may be removed at the point of purchase for loading with a stored value. The card is then installed within a pocket provided in the holder.

Other advantages of the invention will become apparent from the following description taken in connection with the accompanying drawings, wherein is set forth by way of illustration and example one or more embodiments of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
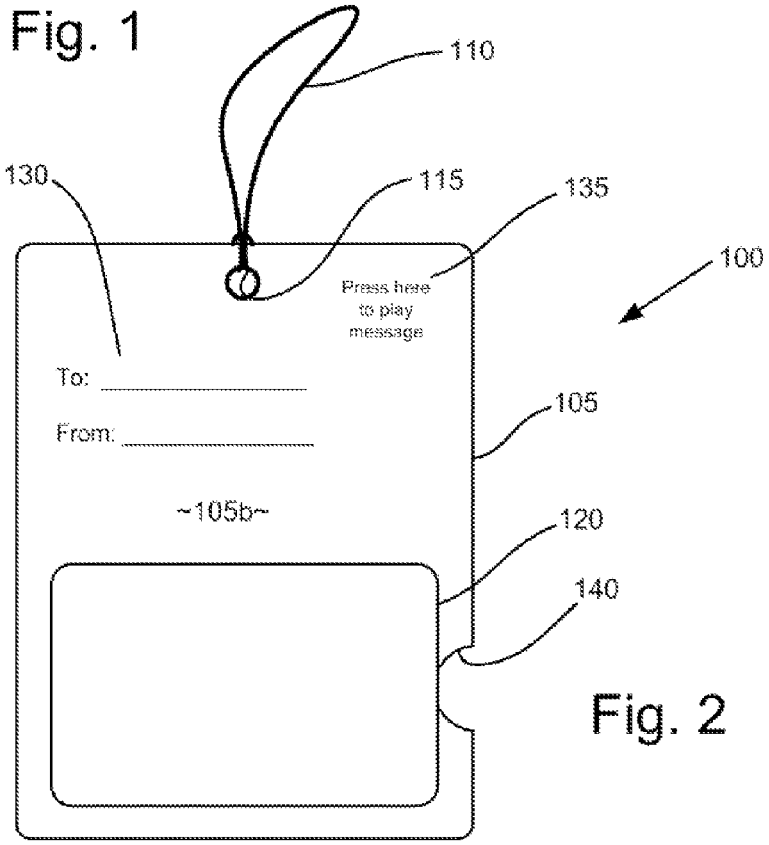
FIG. 1 is a view of an ornament gift card holder showing a gift card removably attached to a front, outside surface thereof.
Figure 2:
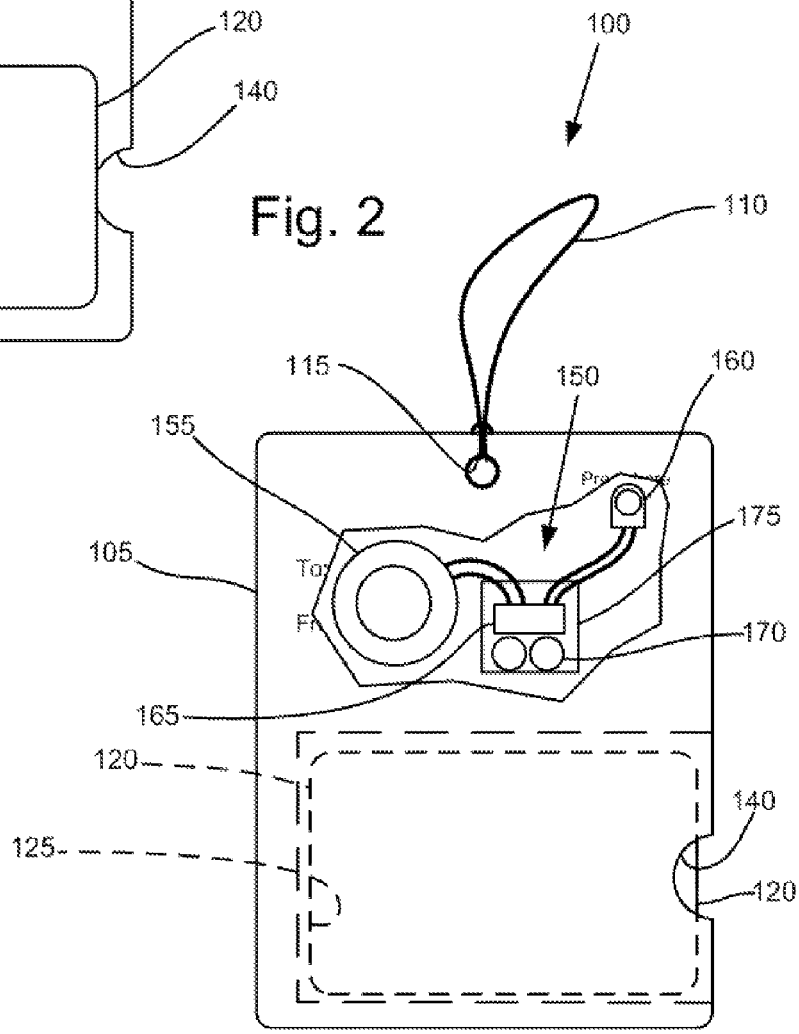
FIG. 2 is a view of the holder of FIG. 1 showing the gift card removed from the front surface of the holder and installed within a holder pocket.
Figure 12:
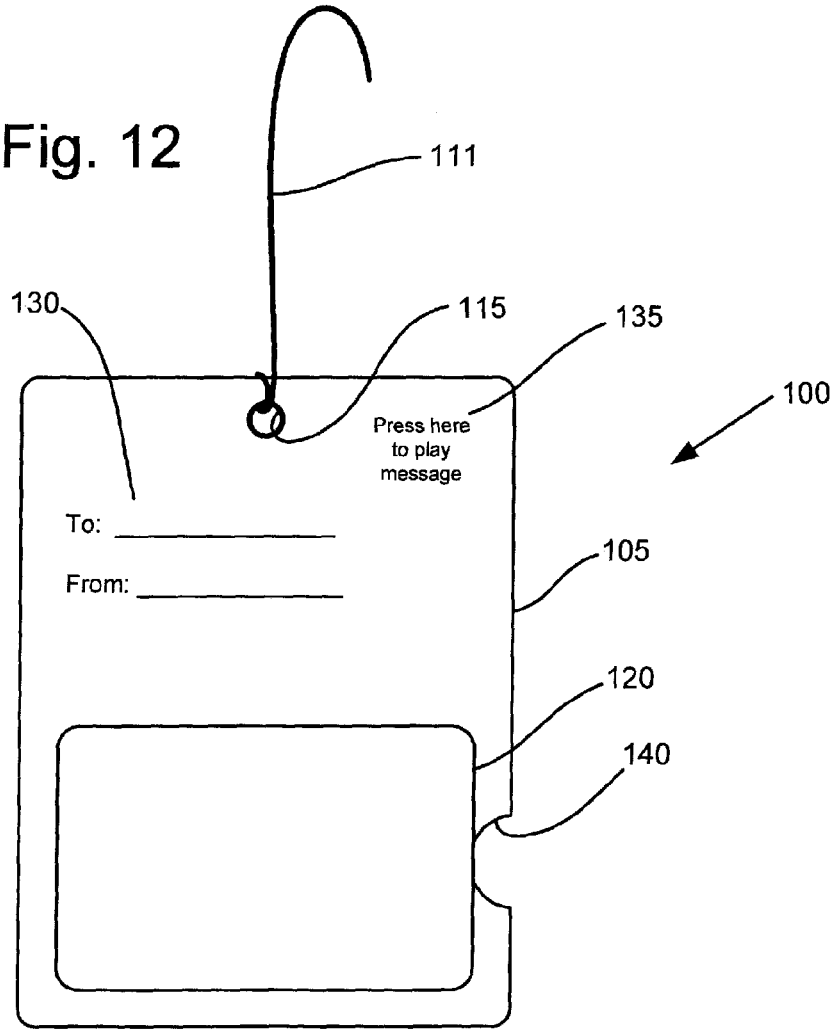
FIG. 12 is a front view of the gift card holder of FIG. 1 showing a hook in place of a loop for hanging the gift card holder on display upon a Christmas tree or other holiday display structure.

Referring now to FIGS. 1 through 7, there is shown in FIGS. 1 and 2 an ornament gift card holder 100 comprising a generally rectangular main body 105. The main body 105 typically comprises an inner foam panel or core 105*a* laminated between two external sheets 105*b* of adhesive paper or plastic, e.g. foam board or an equivalent structural material. The external sheets 105*b* may include any desired text or graphic designs. The holder 100 includes a means for hanging the holder 100, such as a string, wire or plastic loop 110 passed through a hole 115 in the upper portion of the main body 105. FIG. 12 is a front view of the gift card holder 100 showing a hook 111 in place of the loop 110 for hanging the gift card holder 100 on display upon a Christmas tree or other end-user holiday display structure.

As shown in FIG. 1, a gift card 120 may be removably attached to a front, outside surface of the main body 105 for later removal and storage or use. Indicia on the front surface of the holder 100 may be provided to indicate the identity of the gift giver and recipient, i.e. "to/from" indicia 130. Activation indicia 135 may also be provided to indicate the location of an underlying switch 160 used to activate a sound circuit 150 held within the holder 100.

FIG. 2 is a view of the holder 100 of FIG. 1 showing the gift card 120 removed from the front surface of the holder 100 and installed within a holder pocket 125. As shown, the right margin of the holder 100, and of the pocket 125, includes a notch 140 to enable removal of the card 120 from the pocket 125 by grasping a portion of the card 120 which is revealed by the notch 140.

Audio components 150 of the gift card holder 100 are held within a chamber 107 formed in the foam core 105*a* of the upper portion of the main body 105. The audio components 150 typically include a speaker 155 for recording and playing back sound, a record and playback button 160, control and storage circuitry 165 including an integrated circuit and random access memory, and a power source such as one or more watch batteries 170. All or some of these audio components 150 may be mounted upon a circuit board 175 or similar structure. The circuit board 175 is typically generally rectangular and is sized to fit within the space available in the chamber 107 of the main body 105. The circuit board 175 may be formed of materials commonly used for such purpose in the prior art, typically a thermally stable non-conductive material such as thermoset plastic or epoxy-fiberglass laminates. An example of appropriate prior art circuitry of the type that may be adapted for use with this device includes a digital recording unit sold by Radio Shack, part no. 276-1323.

The record and playback button 160 typically comprises a pressure sensitive switch. When the button 160 is pressed for an extended period of time, e.g. approximately 5 seconds, the audio circuit engages a record function and the user may record an audible message into memory by speaking into the speaker 155. When the button 160 is pressed for only a brief moment, e.g. typically less than 5 seconds, the audio circuit engages a playback function and the recorded message is retrieved from digital memory and played over the speaker 155.

Figure 3:
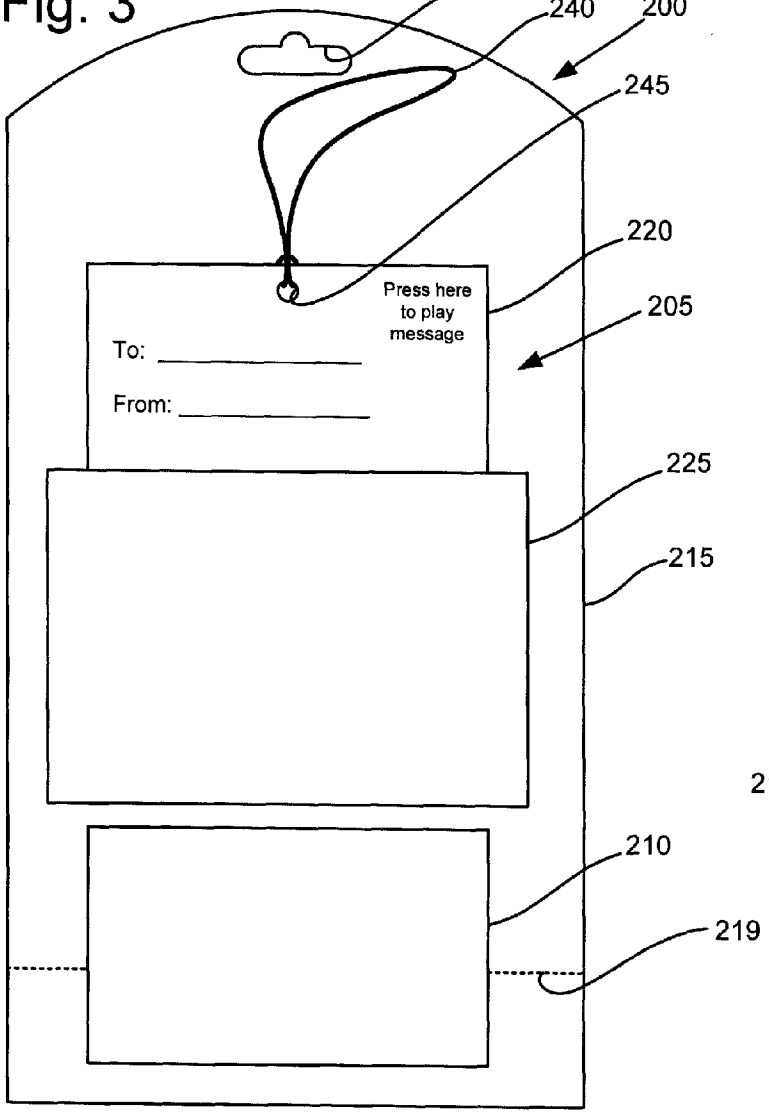
FIG. 3 is a view of an alternative embodiment of an ornament gift card holder wherein the ornament and the gift card are separately and removably mounted on a hang tag backing card.

FIG. 3 is a view of an alternative embodiment of an ornament gift card holder 200 wherein the ornament 205 and the gift card 210 are separately and removably mounted on a hang tag backing card 215. The backing card 215 includes a peg hole 217 for hanging the holder 200 upon a retail display stand peg (not shown). The backing card 215 may comprise cardboard, heavy paper including card stock, plastic, foam board or any sufficiently resilient material of sufficient size and dimensions to hold the ornament 205 and gift card 210.

The ornament 205 may comprise cardboard, heavy paper including card stock, plastic or foam board. Preferably, the ornament 205 comprises foam board, a foam core laminated between sheets of adhesive paper or plastic. The ornament 205 includes an upper portion 220 and a lower portion 225. Electronic audio components 230 are stored in the upper portion 220 as shown in FIG. 4 in which a portion of the front surface of the upper portion 220 is broken away to reveal the audio components 230 positioned therein.

A string or cord 240 is looped and tied through a hole 245 in the ornament 205 to provide a means for hanging the ornament 205 once detached from the backing card 215. The ornament 205 and gift card 210 are typically held on the surface of the backing card 215 with removable adhesive. Alternatively, the entire assembly, as shown in FIG. 3, may be wrapped in clear plastic or cellophane and/or shrink wrapped to hold the ornament 205 and gift card 210 to the backing card 215.

Figure 4:
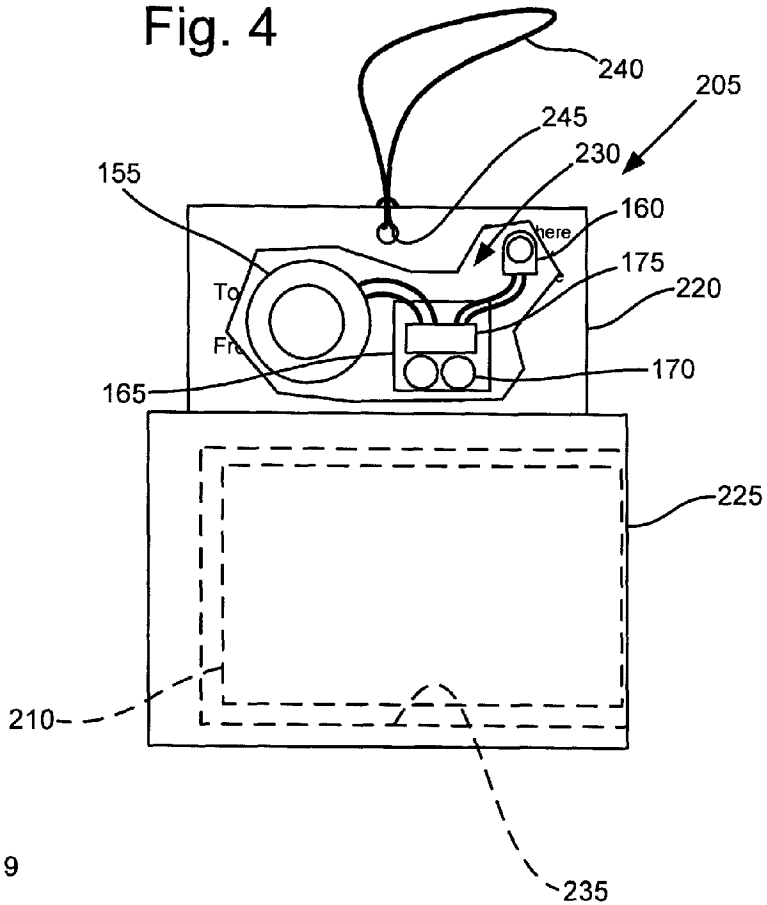
FIG. 4 is a view of the ornament of FIG. 3 removed from the backing card and showing audio components held within the upper portion of the ornament.

The lower portion 225 of the ornament 205 includes a slot or pocket, shown in dashed lines 235 in FIG. 4, for receiving and holding a gift card 210 after activation/loading. The card 210 is removed and loaded at the point of sale and installed within the pocket 235 by the gift giver. The gift card 210 is shown in dashed lines positioned within the pocket 235. After receipt from the gift giver, the recipient simply slides the gift card 210 out of the pocket 235 by grasping the card 210 through notch 140 and pulling the card 210 away from the ornament 205 until the card 210 is completely removed from the pocket 235.

Figure 9:
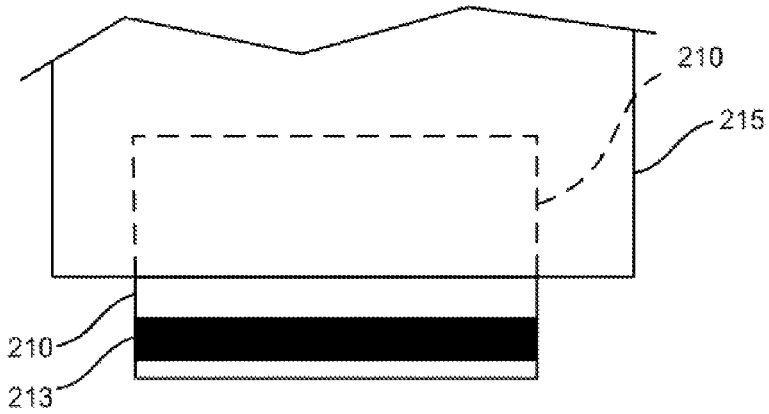
FIG. 9 is a partial view of an alternative embodiment of the gift card holder of FIG. 3 wherein the gift card is positioned to project below the lower margin of the backing card.

Alternatively, the backing card 215 may include a scored line 219 positioned to facilitate bending the lower portion of the backing card 215 away from the gift card 210 to allow access to the gift card magnetic strip 213 (see FIG. 9 for a view of the rear surface of a gift card 210 bearing a magnetic strip 213).

In an alternative embodiment of the gift card holder 200, the gift card 210 projects below the backing card 215 (see FIG. 9) sufficiently so that the magnetic strip 213 of the gift card 210 can be swiped through a card reader without detachment from the backing card 215 (see FIG. 9). This allows the user to load the card 210 with a selected stored value with no disassembly required at the point of purchase. Removal of the gift card 210 from the backing card 215 and installation within the pocket 235 may then occur at the user's leisure following the purchase.

Figure 10:
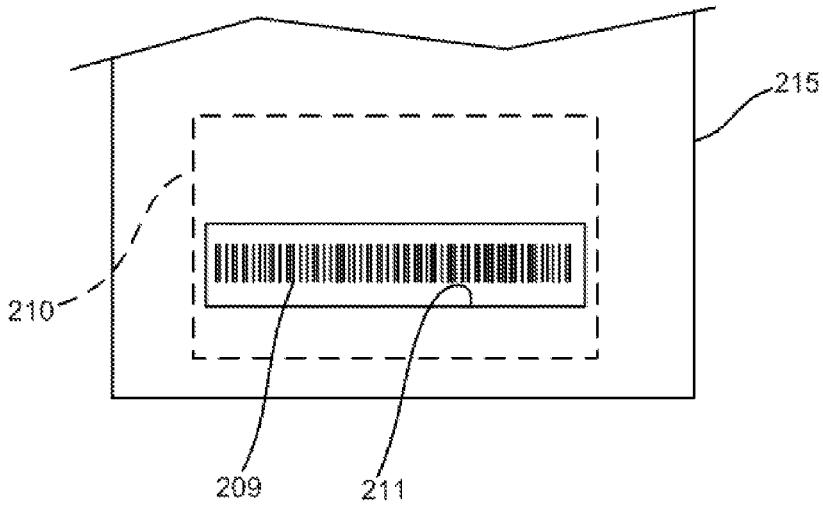
FIG. 10 is a partial view of an alternative embodiment of the gift card holder of FIG. 3 wherein the backing card is provided with an aperture through which the gift card bar code may be viewed and scanned without removal of the gift card from the backing card.

In yet a further embodiment, the backing card 215 is provided with an aperture 211 through which a portion of the gift card 210 bearing a bar code 209 may be viewed and scanned without removal of the gift card 210 from the backing card 215 (see FIG. 10).

Figure 5:
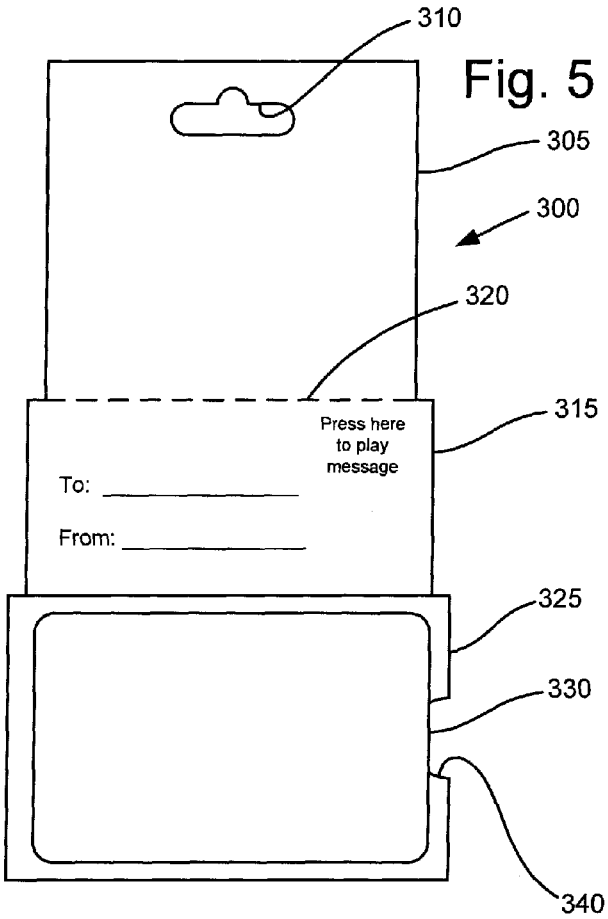
FIG. 5 is a view of a further alternative embodiment of a gift card holder.
Figure 6:
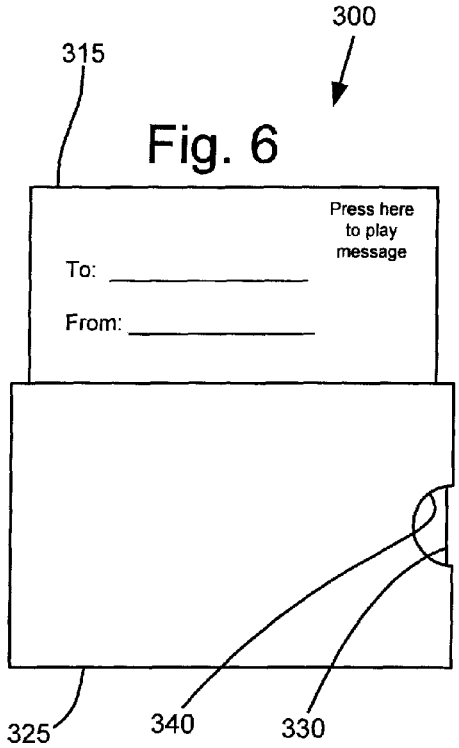
FIG. 6 is a view of the holder of FIG. 5 with the hang tag portion removed and the gift card installed in the pocket.

FIG. 5 is a view of an embodiment of a gift card holder 300 comprising an upper hang tag portion 305 that includes a peg hole 310, a main body portion 315 that may be torn from the hang tag portion 305 along a line of perforation 320 therebetween, and a pouch or envelope 325 attached to the lower portion of the main body 315. As shown in FIG. 5, the hang tag 305 is attached to the main body 315 and the gift card 330 is removably attached to the front outer surface of the pouch 325, typically using removable adhesive or the like. This configuration is appropriate for display of the holder 300 for sale by hanging the holder 300 upon a retail display stand peg (not shown). FIG. 6 is a view of the holder 300 with the hang tag portion 305 removed and the gift card 330 installed within the pouch 325 as appropriate for presenting the holder 300 and installed card 330 to the gift recipient. As shown, the right margin of the pouch 325 includes a notch 340 to enable removal of the card 330 from the pouch 325 by grasping a portion of the card 330 which is revealed by the notch 340.

Figure 7:
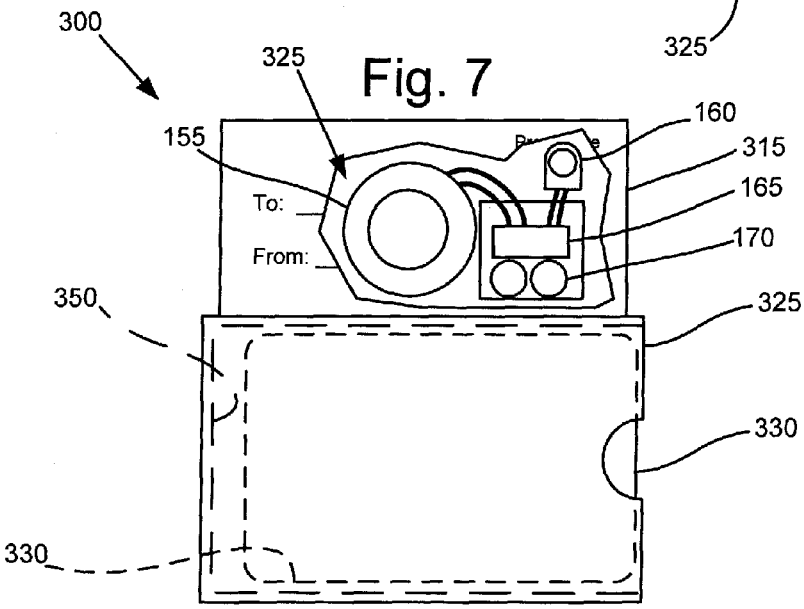
FIG. 7 is a view of the holder of FIG. 6 showing audio components held within the holder main body.
Figure 8:
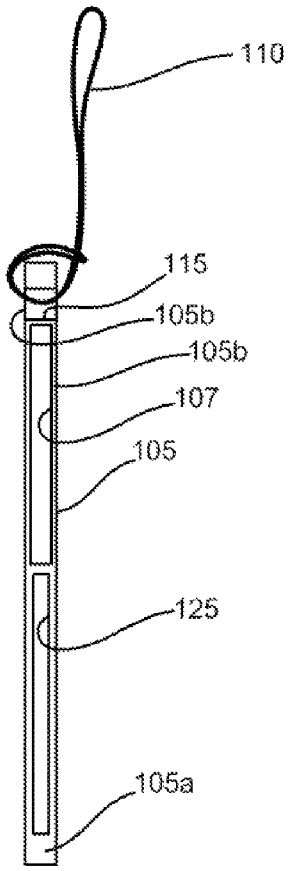
FIG. 8 is a sectional view of the gift card holder of FIG. 1.
Figure 11:
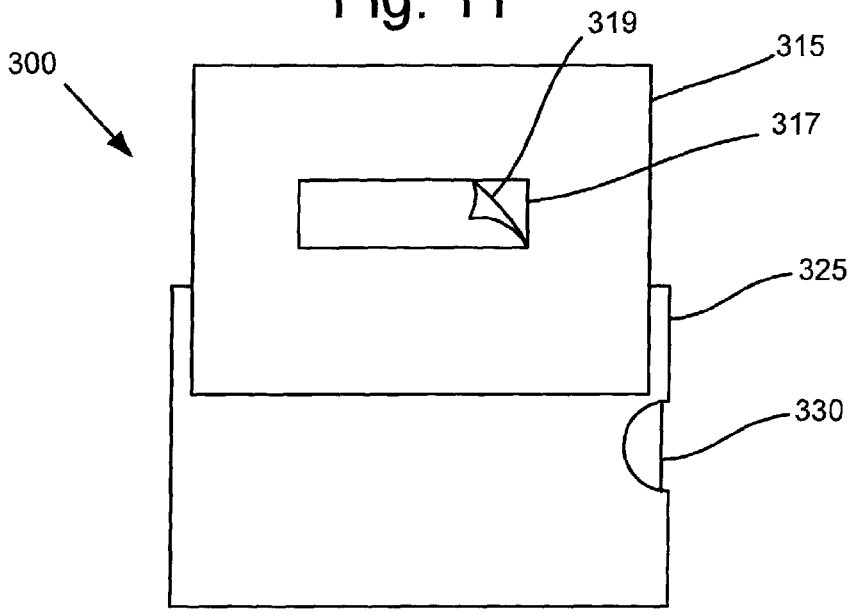
FIG. 11 is a rear view of the gift card holder of FIG. 6 showing a section of adhesive tape attached to the rear surface of the gift card holder and a section of protective film partially removed from the adhesive tape.

Typically, the gift card 330 will include a magnetic strip for storing a selected stored value. Prior to gifting, the purchaser/gift giver removes the card 330 from the outer surface of the pouch 325 and loads the magnetic strip with a selected stored value by passing the card through a magnetic strip reader equipped with appropriate software and hardware for completing the transaction. FIG. 7 illustrates the gift card 330 held within interior pocket 350 of the pouch 325 and a breakaway view of the audio components 335 held within the main body 315. As shown in FIG. 11, the main body portion 315 (or the pouch 325) may include a strip or section of adhesive tape 317 attached to the rear surface of the gift card holder 300. Protective film 319 (shown partially removed from the adhesive tape 317) is removed from the tape 317 to allow the holder 300 to be attached or mounted to a gift or other item or surface.

Having thus described the invention, what is claimed as new and desired to be secured by Letters Patent is:

1. An ornament gift card holder comprising:

a main body comprising an inner foam panel between external sheets, means for hanging said main body upon an end-user holiday display structure, a gift card removably attached to an outer surface of said holder, a pocket within said main body for later receiving said gift card, and audio components for playing sound held within a separate chamber of said main body.

2. The card holder of claim 1, wherein said means for hanging comprises an appropriately sized loop attached to said holder.

3. The card holder of claim 1, wherein said means for hanging comprises an appropriately sized hook attached to said holder.

4. The card holder of claim 1, wherein said gift card is removably attached to a front surface of said holder.

5. The card holder of claim 1, further comprising indicia upon a surface of said holder.

6. The card holder of claim 1, further comprising activation indicia upon a surface of said holder.

7. The card holder of claim 1, further comprising a notch formed in the right margin of said holder for enabling a card stored therein to be grasped.

8. The card holder of claim 1, wherein said main body and said gift card are separately and removably mounted upon a backing card.

9. The card holder of claim 1, further comprising adhesive attached to a rear surface of said main body for attachment of said main body to an item or surface.

10. A gift card holder comprising:

a main body comprising an inner foam panel laminated between external sheets, said main body including a pocket within said foam panel for receiving and removably holding a gift card and a chamber within said foam panel for housing audio components, said main body including activation indicia thereon for indicating a location of an underlying switch used to active said audio components, and a loop or hook projecting from said main body to provide a means for hanging said holder upon a structure.

11. An ornament gift card holder comprising:

an ornament comprising an inner foam panel laminated between external sheets, said ornament including a pocket within said foam panel for receiving and removably holding a gift card and a chamber within said foam panel for housing audio components, said ornament including activation indicia thereon for indicating a location of an underlying switch used to active said audio components, said ornament attached to a backing card; and a loop or hook projecting from said ornament to provide a means for hanging said ornament upon a structure.

* * * * *